US005887771A

United States Patent [19]

Perry

[11] Patent Number: 5,887,771

[45] Date of Patent: Mar. 30, 1999

[54] BACK SUPPORTED UMBRELLA HOLDER

[76] Inventor: David J. Perry, 801 Whitehall St., Jackson, Tenn. 38301

[21] Appl. No.: 630,891

[22] Filed: Apr. 2, 1996

[51] Int. Cl.[6] ..... A45B 11/02

[52] U.S. Cl. ..... 224/190; 224/632; 224/644; 224/196; 224/907; 224/930; 224/628

[58] Field of Search ..... 224/189, 190, 224/188, 187, 186, 185, 632, 628, 644, 261, 262, 196, 930, 907

[56] References Cited

U.S. PATENT DOCUMENTS

| | | | |
|---|---|---|---|
| 191,782 | 6/1877 | Smith . | |
| 202,140 | 4/1878 | Bowers . | |
| 225,409 | 3/1880 | Mora | 224/190 |
| 229,912 | 7/1880 | Ray . | |
| 595,218 | 12/1897 | Stauffer | 224/186 |
| 903,682 | 11/1908 | Cumpston . | |
| 1,041,577 | 10/1912 | Bekkevar | 224/190 |
| 1,205,917 | 11/1916 | Merrill . | |
| 1,347,540 | 7/1920 | Godard . | |
| 1,460,821 | 2/1923 | Morris . | |
| 1,704,407 | 5/1929 | Rice | 224/190 |
| 2,223,253 | 8/1940 | Hamilton . | |
| 2,496,769 | 1/1950 | Battle . | |
| 3,204,650 | 9/1965 | Shinew . | |
| 3,554,203 | 1/1971 | Hall . | |
| 4,188,965 | 2/1980 | Morman . | |
| 4,537,339 | 8/1985 | Pearson | 224/188 |
| 4,657,037 | 4/1987 | Garrido . | |
| 4,798,319 | 1/1989 | James, Jr. | 224/196 |
| 4,967,943 | 11/1990 | Massey . | |
| 5,004,135 | 4/1991 | Dufournet et al. | 224/262 |
| 5,174,482 | 12/1992 | Rogers et al. | 224/196 |

*Primary Examiner*—Linda J. Sholl
*Attorney, Agent, or Firm*—Baker, Donelson, Bearman & Caldwell

[57] ABSTRACT

An umbrella support device for securing an umbrella in an operative position for a user, comprising a frame securable to the user's back and at least one receptacle for retaining the handle of a conventional umbrella. A fastening system is incorporated in the receptacle, having a pair of arms selectively movable between open and closed positions for enabling the user to insert the handle in the receptacle and secure the handle therein. In a first embodiment, the handles include rigid gripping members extending into the receptacle, which engage the umbrella shaft immediately adjacent the handle upon insertion of the handle into the receptacle. In a second embodiment, the gripping members are replaced with latch bolts having inclined upper surfaces, so that insertion of the handle automatically moves the arms to their open position.

3 Claims, 6 Drawing Sheets

BACK SUPPORTED UMBRELLA HOLDER

BACKGROUND

The present invention relates to umbrellas and, more particularly, to a back supported umbrella holding device.

A need has long been recognized for a device which holds an umbrella in an operative position over a user's head to provide protection from either the sun or rain while leaving the user's hands free for other tasks. Examples of efforts to devise umbrella support structures for this general purpose are shown in the following U.S. Pat. No. 191,782 issued Jun. 12, 1877 to Smith; U.S. Pat. No. 202,140 issued Apr. 9, 1877 to Bowers; U.S. Pat. No. 229,912 issued Jul. 13, 1880 to Ray; U.S. Pat. No. 1,460,821 issued Jul. 3, 1923 to Morris; U.S. Pat. No. 2,223,253 issued Nov. 26, 1940 to Hamilton; U.S. Pat. No. 2,496,769 issued Feb. 7, 1950 to Battle; U.S. Pat. No. 3,204,650 issued Sep. 7, 1965 to Shinew; U.S. Pat. No. 3,554,203 issued Jan. 12, 1971 to Hall; and U.S. Pat. No. 4,188,965 issued Feb. 19, 1980 to Morman. However, all of the known support devices are either too complicated for commercial feasibility, or require a specially configured umbrella which can only be used with the support device.

Accordingly, a need continues to exist for a device which supports an umbrella in an operative position on the back of a user, which is simple in construction, accommodates and securely locks into place a conventional umbrella handle, and is easily adjustable to the height and working position of the user. The present umbrella support device overcomes the limitations of the prior art by adopting a configuration which supports a conventional umbrella, is simple to construct, has a comfortable, padded back support and is easily adjustable. Further, the present device has a simple locking mechanism to securely lock into place a conventional umbrella. The umbrella support device may also include additional receptacles and compartments for storing a water bottle, a portable radio, or a second umbrella, as well as a battery-powered fan to help cool the user when working outdoors in warm weather.

SUMMARY OF THE INVENTION

It is an object of the present invention to provide a device for supporting on the back of a user a conventional umbrella having a straight handle.

Another object of the invention is to provide such an umbrella support device which is simple to construct and use.

An additional object of the invention is to provide means for adjusting the position of the umbrella to accommodate the user's height or working position.

A further object of the invention is to provide additional support structure on the device for attaching additional items for the convenience of the user, such as a water bottle, radio, fan, or similar accessory item.

In order to achieve these and other objects, the present invention is a device for securing an open umbrella to the back of a user. The device comprises a frame having front and back sides, at least one strap member which is attached to the frame and securable about a portion of the user's body for securing the frame in an operative position on the user's back, and an umbrella receptacle affixed to the back side of the frame for receiving the handle of an umbrella. Fastening means are operatively disposed within the umbrella receptacle for releasably engaging the handle to secure the umbrella in a position suitable for providing shade or protection from rain for the user. Preferably, the umbrella receptacle is a hollow vertically-oriented tubular member. The fastening means may comprise a pair of spring-loaded latch bolts disposed in the umbrella receptacle for automatically engaging the umbrella handle. In a particularly preferred embodiment, the umbrella receptacle is provided with a means for adjusting the vertical position of the umbrella to accommodate the height of the user and a means for tilting the open umbrella to provide shelter when the user is in a stopped or bent working position.

Other objects and advantages of this invention will become apparent to those skilled in the art upon reading the following detailed description in conjunction with the appended drawings.

DETAILED DESCRIPTION

Figure 1:
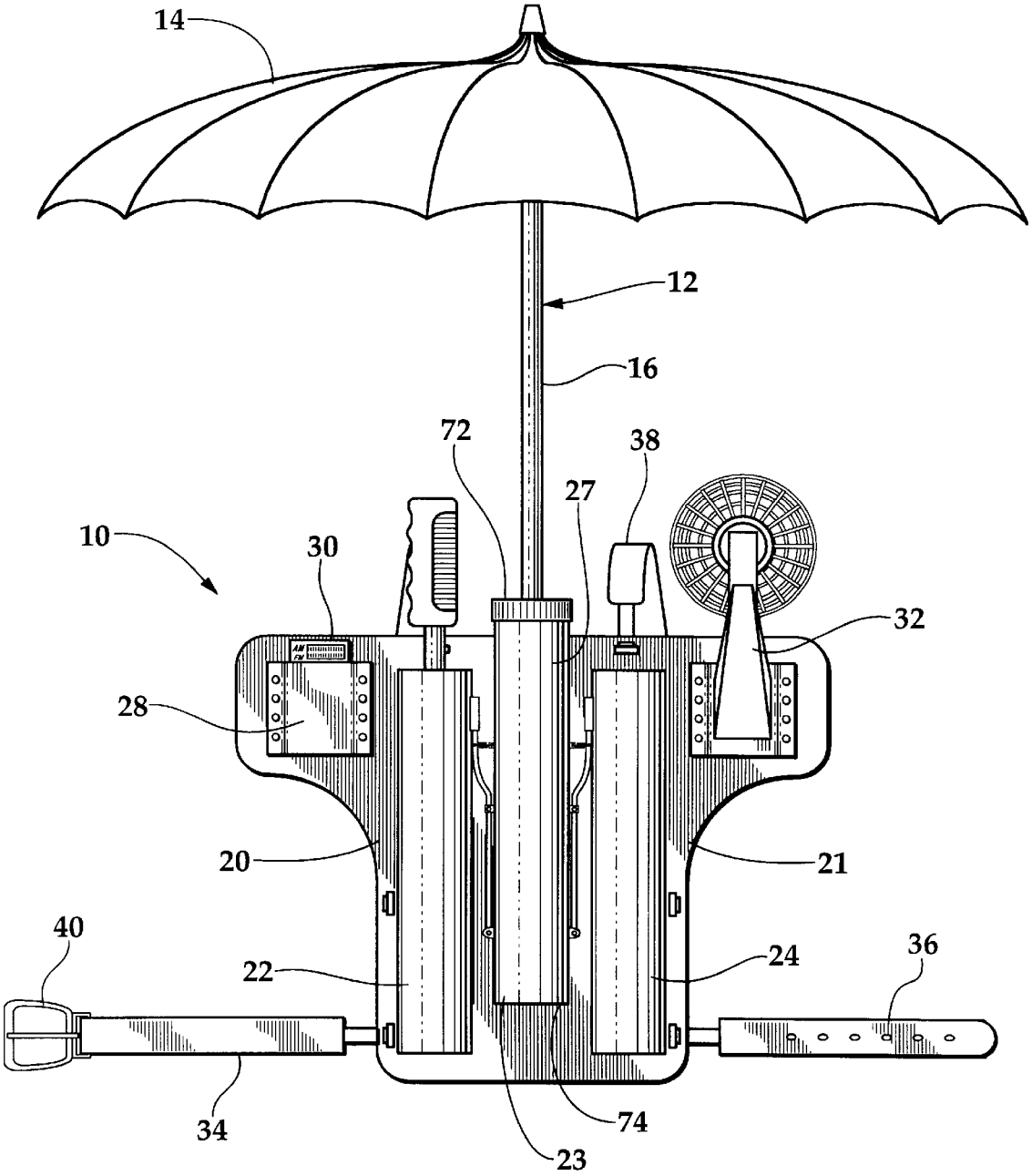
FIG. 1 is a rear elevational view showing my new umbrella support device.
Figure 2:
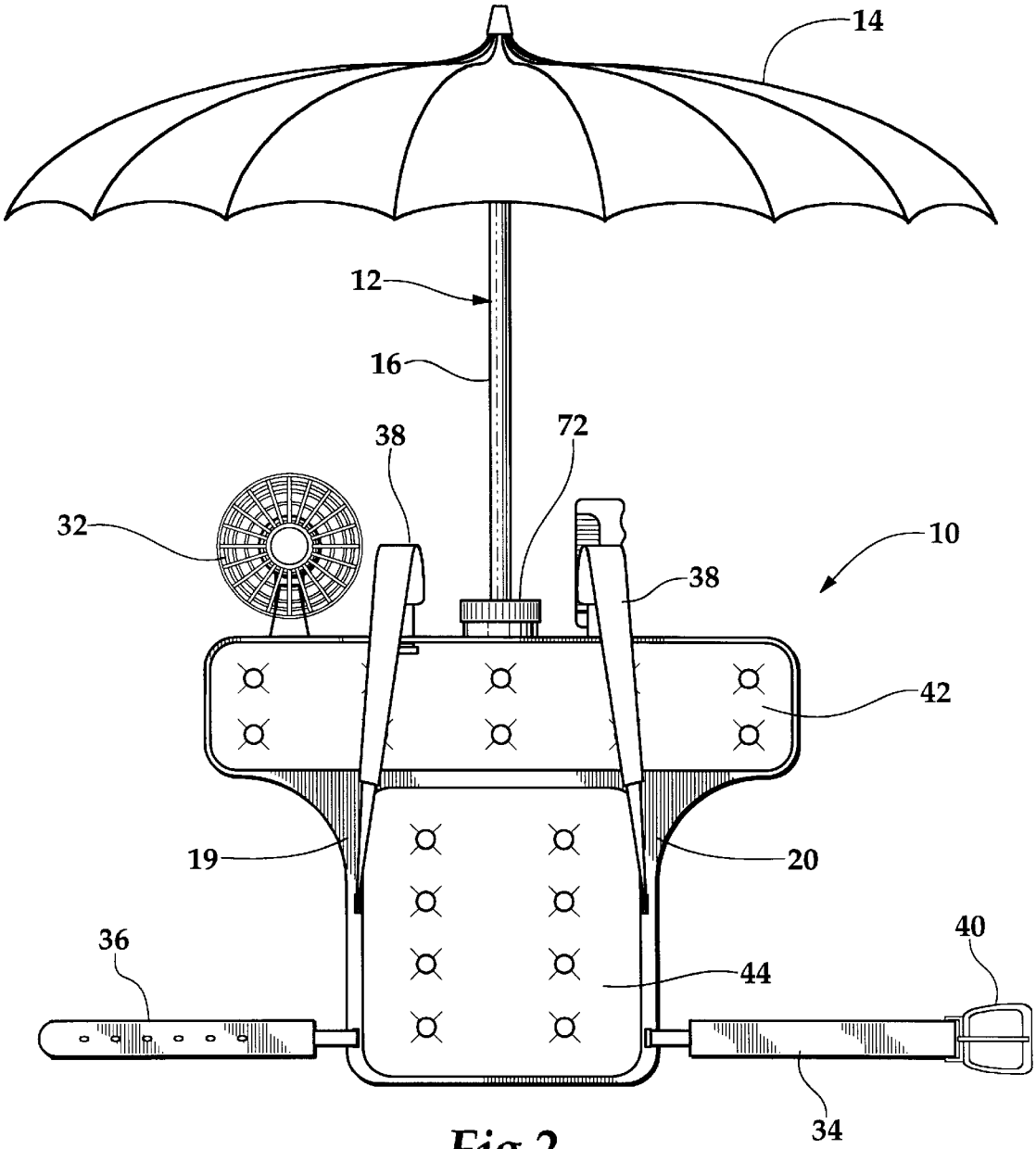
FIG. 2 is a front elevational view of the present umbrella support device.
Figure 5:
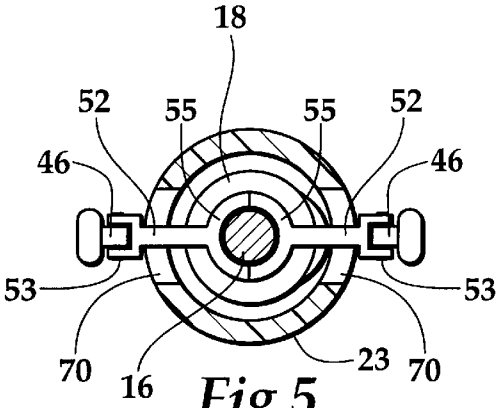
FIG. 5 is a top plan view, partially in section, through the umbrella receptacle as shown in FIG. 3.
Figure 6:
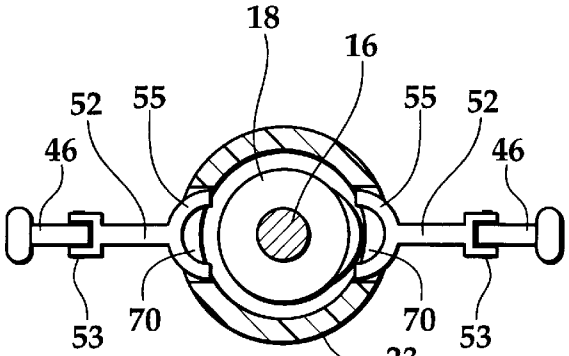
FIG. 6 is a top plan view, partially in section, of the umbrella receptacle as shown in FIG. 4.
Figure 3:
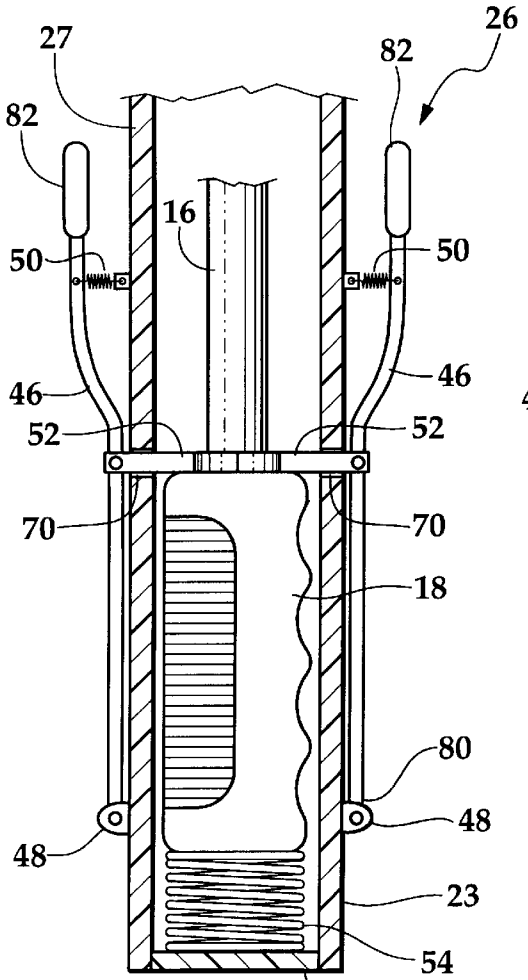
FIG. 3 is an enlarged sectional view through the umbrella receptacle of the device shown in FIGS. 1 and 2, with the umbrella handle secured therein.

Referring to FIGS. 1–3, the umbrella support device 10 of the present invention includes a frame 20 having a front 19 and a back 21, straps 34, 36 and 38 for securing the umbrella support device 10 to the back of the user, and an umbrella receptacle 23 which is mounted to the back 21 of the frame 20. The umbrella receptacle 23 supports and secures a conventional umbrella 12 having a canopy 14, a shaft 16 and a handle 18. The umbrella receptacle 23 preferably is a hollow vertical tube 27 which is open at the top end 72 and a closed at the bottom end 74. The umbrella receptacle 23 is mounted to the back 21 of the frame 20 and is provided with fastening means 26 for easily and securely locking and retaining the handle 18 of the umbrella 12 within the umbrella receptacle 23 so that the umbrella 12 remains in a desired position over the user's head. As further described below, the fastening means 26 may include a pair of gripping members 52 which extend through two openings 70 provided in tube 27 to secure the handle 18 of the umbrella 12 within the umbrella receptacle 23. The gripping members 52 are attached to spring-loaded arms 46 for automatically engaging the gripping members 52 around the handle 18 of the umbrella 12. In a preferred embodiment, straps 34 and 36 are secured around the user's waist, while straps 38 form a harness over the user's shoulders. The frame 20 may be formed in a single piece and can be constructed of any suitable rigid material such as plastic, metal, leather or fabric. In a particularly preferred embodiment, padding 44 is attached to the front 19 of the frame 20 to cushion the back and shoulders of the user. Accessory receptacles, such as receptacles 22 and 24, may be attached to the back side of the frame 20 for holding a drinking container or an additional umbrella. Similarly, other accessories may include a compartment 28 for holding a portable radio 30 and a fan 32 for blowing cool air toward the user's face and upper body.

Referring to FIGS. 3–6, a first embodiment of the fastening means 26 of the present invention preferably comprises a pair of gripping members 52 which extend through opposing openings 70 in umbrella receptacle 23 to grip the shaft 16 of umbrella 12 at a point immediately adjacent to the top of handle 18. The gripping members 52 are attached to a pair of arms 46 for engaging and disengaging the gripping members from the shaft 16. Each of the gripping members 52 includes a proximal end 53 which is attached to one of the arms 46 and an arcuately shaped distal end 55. The arcuately shaped distal ends 55 are disposed in close proximity to one another and substantially surround the circumference of the shaft 16 when the handle 18 is positioned within receptacle 23 and the gripping members 52 are in a closed position as shown in FIG. 3. One end 80 of each arm 46 is connected to the umbrella receptacle 23 by a hinge 48 attached to the exterior 25 of the umbrella receptacle 23 at a point near the closed end 74. A point near the opposite end 82 of each arm is connected to a tension spring 50 which is attached to the exterior of the umbrella receptacle 23 above the opening 70. The hinges 48 provide a pivot point for the arms 46 and work in conjunction with the tension springs 50 to hold the arms 46 and gripping members 52 in a normally closed position. Typically, the pairs of hinges 48, tension springs 50, and openings 70 are located on opposite sides of the umbrella receptacle 23. In a particularly preferred embodiment, a compression spring 54 is disposed within the umbrella receptacle 23 and attached to end 74. The compression spring 54 exerts force against the umbrella handle 18 to secure the umbrella handle 18 against the gripping members 52 and to automatically eject the umbrella 12 when the gripping members 52 are disengaged from the umbrella shaft 16.

Figure 4:
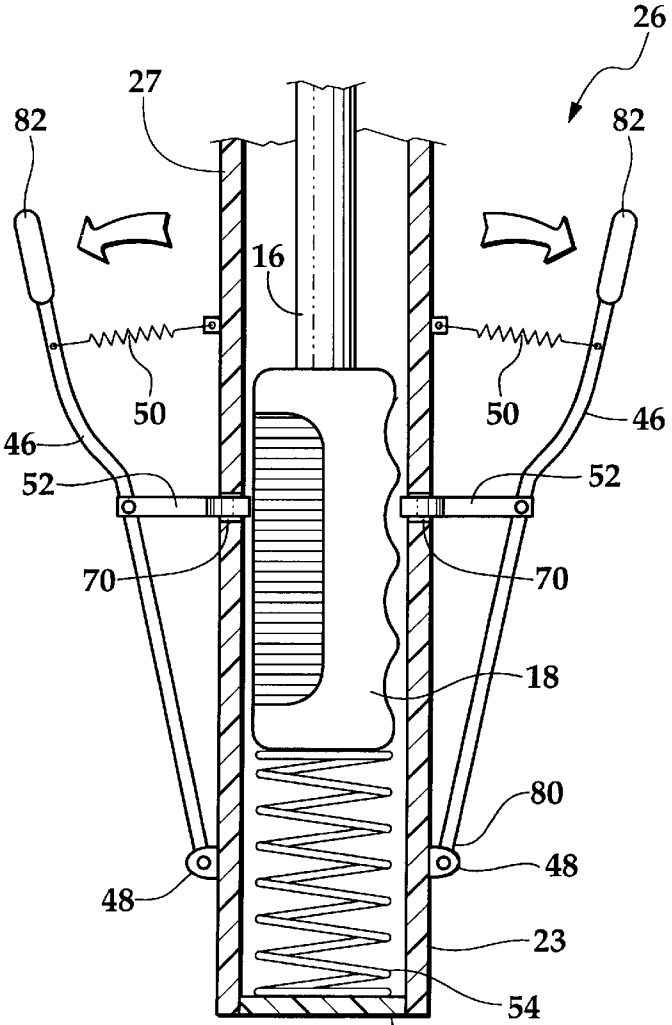
FIG. 4 is a sectional view similar to FIG. 3, showing the umbrella handle during the process of installation.

As best shown in FIG. 4, the umbrella 12 is installed in the umbrella support device 23 by pulling the arms 46 outward to move the gripping members 52 to an open position and inserting the umbrella handle 18 into the umbrella receptacle 23 through the top end 72 to compress the spring 54. As viewed in FIGS. 3 and 5, after the umbrella handle 18 is fully inserted, arms 46 are released to automatically return to the normally closed position. The gripping members 52 then engage the umbrella shaft 16 in an area immediately adjacent to the umbrella handle 18. The gripping members 52, being formed from hard rubber or other rigid material, engage the top surface of the umbrella handle 18 to prevent removal of the umbrella handle 18 from the umbrella receptacle 23 while gripping members 52 are in their closed position. The operation of the gripping members 52 in conjunction with the compression spring 54 securely retains the umbrella handle 18 so that the umbrella 12 is maintained in its operative position. Removal of the umbrella 12 is accomplished by pulling the arms 46 to an open position, and allowing the spring 54 to force the umbrella handle 18 in an upward direction so the umbrella 12 may then be easily withdrawn by the user from the umbrella receptacle 23.

Figures 7, 8, 9:
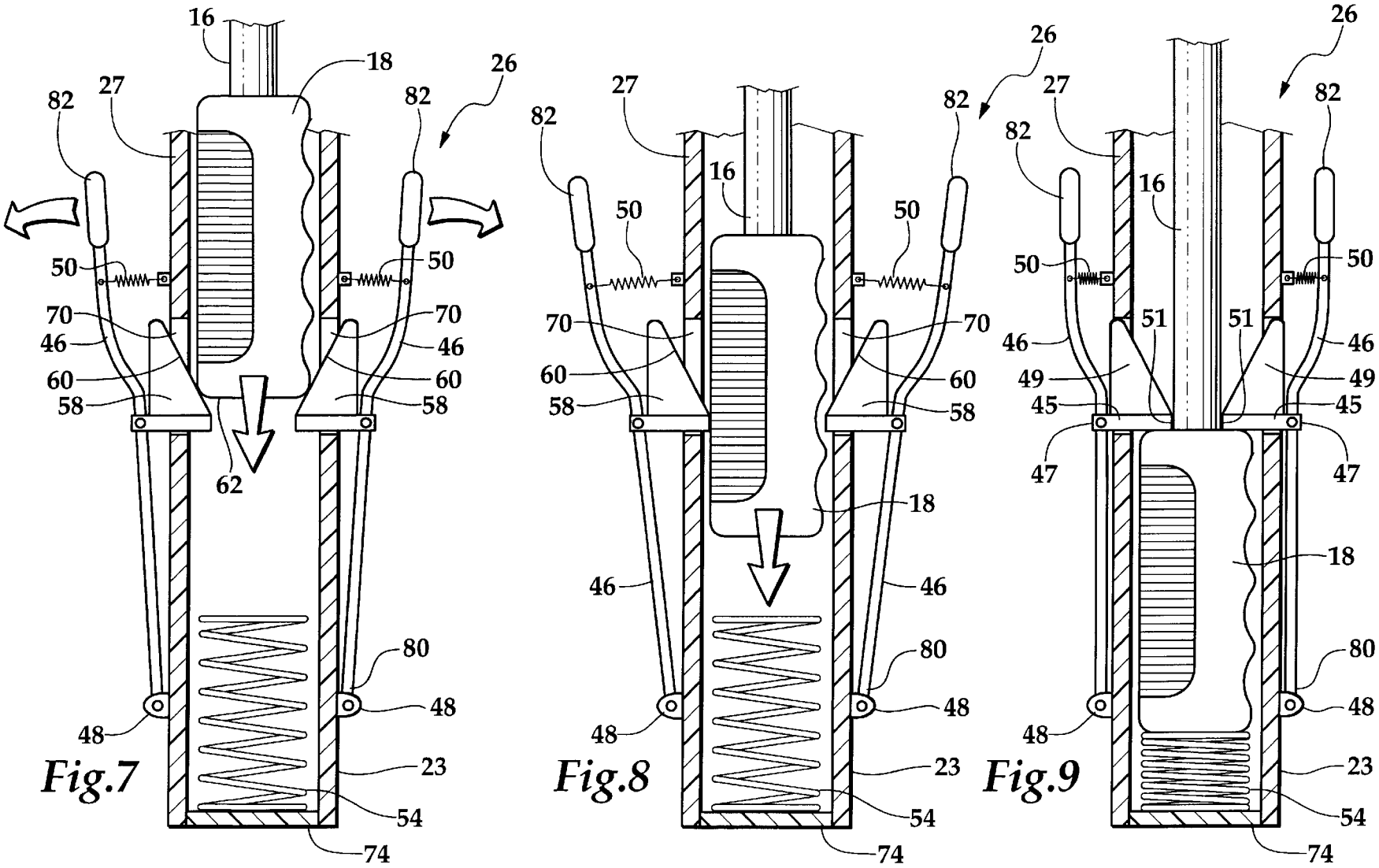
FIG. 7 is a sectional view of an alternative embodiment of the umbrella receptacle, showing the handle in an initial stage of insertion.
FIG. 8 is a sectional view of the alternative embodiment shown in FIG. 7, showing the handle in an intermediate stage of insertion.
FIG. 9 is a sectional view of the alternative embodiment shown in FIGS. 7 and 8, with the handle in its fully inserted position.

In a second embodiment of the device of the present invention, shown in FIGS. 7–9, the fastening means 26 comprises a pair of latch bolts 58 which are secured to each arm 46. Each latch bolt 58 has an inclined upper surface 60 and extends laterally through a suitable opening in the umbrella receptacle 23. Referring to FIG. 9, each latch bolt 58 has a platform portion 45 that is connected near one end 47 to arm 46. The platform portion 45 extends in a substantially perpendicular direction from arm 46 and through opening 70. Each latch bolt 58 further includes a triangular-shaped portion 49 positioned on the platform portion 45. The triangular-shaped portion 49 includes the upper surface 60 which extends from a position near an opposite end 51 of the platform portion 45. The upper surface 60 is tilted upward and at an angle directed away from the center of the umbrella receptacle 23 so that the upper surfaces 60 cooperate with each other to form a V-shape in the umbrella receptacle 23. As illustrated in FIG. 7, as the handle 18 is inserted into the umbrella receptacle 23, the lower end 62 of the handle 18 bears upon the inclined surfaces 60. Due to the force on the inclined surfaces 60, the latch bolts 58 are moved laterally outwardly and the arms 46 are moved to their open position shown in FIG. 8. The umbrella handle 18 may then be fully inserted into the lower portion of the umbrella receptacle 23, compressing the spring 54 as described above and as shown in FIG. 9. Once the top surface of the umbrella handle 18 has cleared the latch bolts 58, springs 50 pull the arms 46 back to their closed position, with the lower surface of the latch bolts 58 resting against the top of the umbrella handle 18 to prevent removal of the umbrella handle 18 from the umbrella receptacle 23. The umbrella handle 18 is removed from the receptacle 23 by pulling the arms 46 outwardly towards the open position, to disengage the latch bolts 58 from the handle 18, and allow the handle 18 to be withdrawn from the umbrella receptacle 23. It is to be understood that the principal advantage of this second embodiment is that the user is not required to spread the handles 46 in order to install the umbrella 12, since the handle 18 automatically pushes the arms 46 to an open position.

The umbrella support device 10 of the present invention is secured to the back of a user by means of straps 34 and 36 and shoulder harnesses 38. In a preferred embodiment, the user may slip his or her arms beneath the harnesses 38 so that the harnesses 38 rest comfortably on the user's shoulders. Straps 34 and 36 may then be fastened around the user's waist in a conventional manner utilizing a buckle 40 disposed at the distal end of the strap 34. As best seen in FIG. 2, the front side of the frame 20 includes an upper pad 42 and a lower pad 44 to provide a comfortable cushion between the frame 20 and the user's shoulders and back.

Further, it may be desirable to line the interior of the umbrella support receptacle 23 with a foam cushion or similar resilient material to provide lateral support for the umbrella handle 18 to increase the stability of the umbrella 12. In any case, the umbrella support device 10 uniquely provides support for a conventional umbrella 12, holding the umbrella 12 in its operative position with a canopy 14 protecting the user from rain or sunshine, while freeing the user's hands for other tasks.

Figure 10:
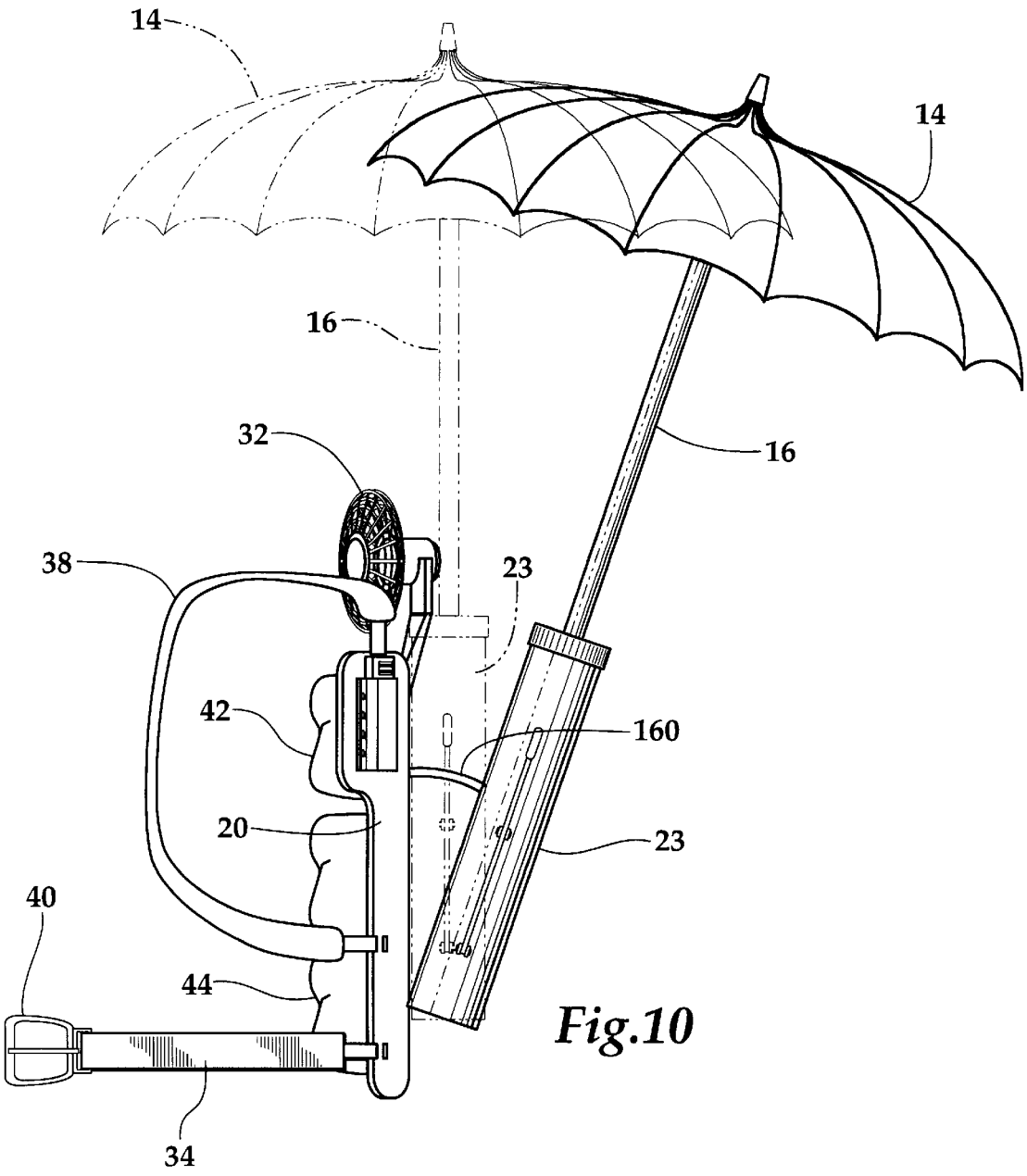
FIG. 10 is a left side view of an alternate embodiment showing the umbrella in a tilted position.
Figure 11:
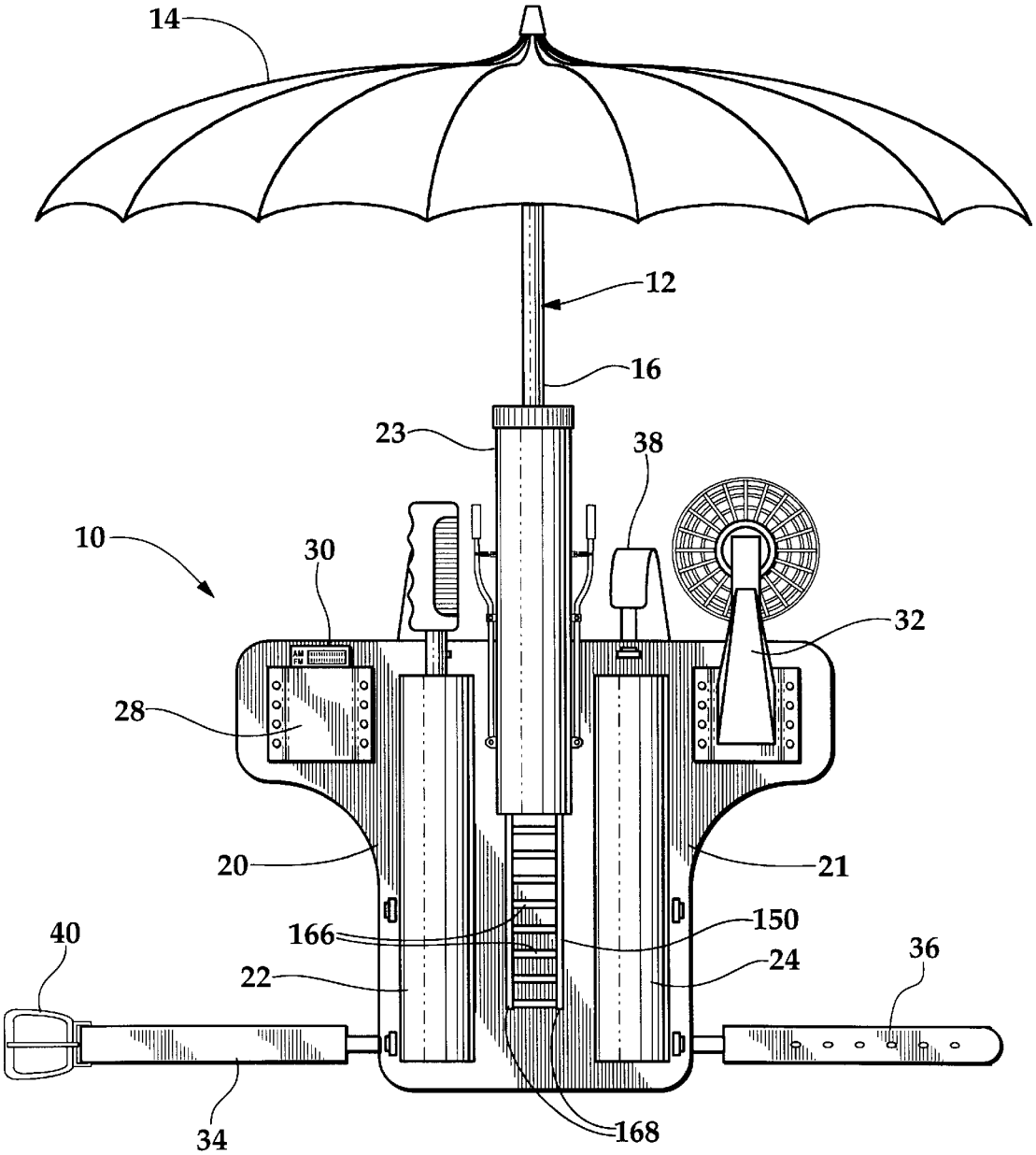
FIG. 11 is a rear elevational view of the umbrella support device of the present invention showing the tumbrella receptacle in a vertically extended position.

Preferably the umbrella receptacle 23 can be adjusted vertically. As shown in FIG. 11, the umbrella receptacle 23 may be mounted on an adjustable track 150 or similar device which is secured to the frame 20. The adjustable track 150 allows the user to raise or lower the umbrella receptacle 23 to a position which is convenient and comfortable for the height of the wearer. The umbrella receptacle 23 also may be equipped with a tilt mechanism 160 such as shown in FIG. 10. The tilt mechanism 160 further permits the angular adjustment of the umbrella support receptacle 23 so that the user can enjoy the protection from the sun provided by the umbrella even when working in a bent or stooped position. In a particularly preferred embodiment, the umbrella receptacle 23 also is equipped with the adjustable track 150 as well as the tilt mechanism 160.

Alternately, the adjustable track 150 may comprise a clip and rung adjustment having a series of rungs 166 spaced apart between two bars 168 which are secured to the back 19 of the frame 20. Clips 170 which are mounted to the umbrella receptacle 23 securely frictionally fasten to the rungs 166 thereby permitting incremental adjustment of receptacle 23.

In a preferred embodiment, an accessory receptacle 24, or a similar receptacle, is secured to the frame 20. Accessory receptacle 24 may hold a container filled with water or some other drinking fluid for consumption by the user. It is also contemplated that the container may have a draw tube 78 which passes up over the top edge of frame 20 and extends towards the user's face, so that the user need only turn his or her head to access the tube and drink from the container. It is to be appreciated that the size, shape, and configuration of the accessory receptacles 22 and 24 may be altered as desired and/or necessary depending upon the intended use for the umbrella support device 10, and should therefore not be taken as limitations on the scope of coverage provided by this patent. Similarly, compartment 28, radio 30, and fan 32 may be omitted or replaced by other components as necessary or desired by the user.

While the principal advantages of this invention are disclosed in the foregoing description, it is to be understood that numerous changes in the preferred embodiments described herein may be made without departing from the spirit and scope of this invention. Accordingly, the scope of coverage provided by this patent is to be limited only by the language of the following claims, and the relevant prior art.

What I claim is:

1. A device for securing an umbrella to the back of a user, said umbrella having a shaft with a handle disposed at a first end, said umbrella support device comprising:

a frame, having front and back sides;

at least one strap member engaging said frame and securable about a portion of the user's body for removably securing said frame in an operative position on the user's back;

an umbrella receptacle having first and second ends, the first end including an access hole for inserting the umbrella handle, said umbrella receptacle having a central longitudinal cavity for receiving the umbrella handle, said umbrella receptacle further including first and second openings, said umbrella receptacle affixed to said back side of said frame;

a pair of arms hingedly secured to said receptacle, said arms being selectively movable between open and closed positions;

a pair of gripping members being attached to and selectively movable with one of said arms between open and closed positions, said gripping members being spaced laterally apart in said open position, thereby allowing said handle to pass between said gripping members and to be positioned below said gripping members within said longitudinal cavity; wherein each said gripping member is attached at a proximal end thereof to one of said arms and extends through one of said first and second openings into said longitudinal cavity, each said gripping member further including an arcuately shaped distal end, said arcuately shaped distal ends being disposed in close proximity to one another within said longitudinal cavity when said gripping members are in said closed position, said arcuately shaped distal ends substantially surrounding a portion of the shaft of the umbrella when the handle is positioned below said gripping members with said cavity and said gripping members are in said closed position thereby preventing removal of said handle from said cavity.

2. A device as set forth in claim 1, further comprising:

a pair of springs attached to said umbrella receptacle; wherein each of said arms includes a first end hingedly secured to said umbrella receptacle and a second end which is connected to one of said springs;

each of said gripping members is attached to one of said arms at a position intermediate said first and second ends of the corresponding one of said arms.

3. A device as set forth in claim 2, wherein:

said tubular member includes a coil spring disposed within the second end thereof, said coil spring being compressible by said handle upon insertion of said handle into said cavity thereby forcing said handle against said gripping members.

* * * * *